US008506054B1

(12) United States Patent
Liao

(10) Patent No.: US 8,506,054 B1
(45) Date of Patent: Aug. 13, 2013

(54) INKPOT LIMITING DEVICE AND MULTIFUNCTIONAL PRINTER USING THE SAME

(75) Inventor: Chin-Chuo Liao, New Taipei (TW)

(73) Assignees: Kinpo Electronics, Inc., New Taipei (TW); Cal-Comp Electronics & Communications Company Limited, New Taipei (TW)

( * ) Notice: Subject to any disclaimer, the term of this patent is extended or adjusted under 35 U.S.C. 154(b) by 0 days.

(21) Appl. No.: 13/615,604

(22) Filed: Sep. 14, 2012

(30) Foreign Application Priority Data

Jul. 9, 2012 (TW) ..... 101124642 A

(51) Int. Cl.
*B41J 2/14* (2006.01)

(52) U.S. Cl.
USPC ..... 347/49

(58) Field of Classification Search
USPC ..... 347/32, 33, 49
See application file for complete search history.

(56) References Cited

U.S. PATENT DOCUMENTS 6,558,789 B1 5/2003 Hamerski et al.
7,632,405 B2 * 12/2009 Siddiqi ..... 210/222
8,162,441 B2 * 4/2012 Lee et al. ..... 347/49
2009/0273630 A1 11/2009 Pan
2011/0134185 A1 6/2011 Yamamoto et al.
2011/0216127 A1 9/2011 Karppinen et al.
2011/0279537 A1 11/2011 Love et al.
2011/0316928 A1 12/2011 Roth et al.

FOREIGN PATENT DOCUMENTS

KR 10-2011-0006500 1/2011
TW 201107147 3/2011

* cited by examiner

*Primary Examiner* — Anh T. N. Vo
(74) *Attorney, Agent, or Firm* — Jianq Chyun IP Office

(57) ABSTRACT

An inkpot limiting device and a multifunctional printer using the same are provided. The multifunctional printer includes a housing and the inkpot limiting device disposed therein. The inkpot limiting device includes a limiting structure, a shaft, a carrier, and a pair of limiting magnets. The limiting structure is disposed on the housing and located in a diameter direction of the shaft. The carrier has a main body portion and a carrying portion and a limiting portion located at opposite sides of the main body portion. The limiting structure and the limiting portion face each other. The limiting magnets include a permanent magnet disposed on one of the limiting structure and the limiting portion and an electromagnet disposed on the other of the limiting structure and the limiting portion. When electricity is applied to the electromagnet, the electromagnet is magnetically attracted to fix with the permanent magnet.

12 Claims, 3 Drawing Sheets

INKPOT LIMITING DEVICE AND MULTIFUNCTIONAL PRINTER USING THE SAME

CROSS-REFERENCE TO RELATED APPLICATION

This application claims the priority benefit of Taiwan application serial no. 101124642, filed on Jul. 9, 2012. The entirety of the above-mentioned patent application is hereby incorporated by reference herein and made a part of this specification.

BACKGROUND OF THE INVENTION

1. Field of the Invention

The invention is related to an inkpot limiting device and a multifunctional printer. The invention is especially related to an inkpot limiting device, which limits the position of an inkpot by magnetic attraction, and a multifunctional printer using the same.

2. Description of Related Art

FIG. 1 and FIG. 2 are partial schematic views of a conventional multifunctional printer. Referring to FIG. 1 and FIG. 2, in order to make sure that ink droplet is not deposited around a nozzle to block the nozzle, an additional scraper 110, which moves relative to the nozzle, is disposed in a reciprocating printing device in the conventional multifunctional printer 100 to scrape off surplus ink from the nozzle.

As shown in FIG. 1 and FIG. 2, a carrier 120 is disposed on a shaft 130. A tolerance is needed for a structure design between a limiting structure 140 and a limiting portion 122 of the carrier 120 of the conventional multifunctional printer 100. Otherwise, the limiting portion 122 of the carrier 120 may be too close to the limiting structure 140, and excessive resistance may be generated when the carrier 120 conducts an axial motion along the shaft 130. However, due to the tolerance, when the scraper 110 is cleaning the nozzle, the scraper 110 may also cause the carrier 120 to rotate around the shaft 130 and be lifted at the same time. Consequently, the amount of interference between a tip and the scraper 110 is changed and cannot be kept at the originally designed value. Thus, when the scraper 110 is cleaning the nozzle, the wiping strength is affected, which may cause nozzle blockage.

SUMMARY OF THE INVENTION

The invention provides an inkpot limiting device, which is capable of firmly limiting a position of a carrier.

The invention provides a multifunctional printer, wherein a distance between the carrier and a scraper is firmly limited.

The invention provides an inkpot limiting device used for limiting a position of an inkpot. The inkpot limiting device includes a limiting structure, a shaft, a carrier, and a pair of limiting magnets. The limiting structure is disposed in a diameter direction of the shaft. The carrier has a main body portion and a carrying portion and a limiting portion located at opposite sides of the main body portion, wherein the shaft passes through the main body portion, and therefore the carrier is rotatable around the shaft. The limiting structure and the limiting portion face each other. The limiting magnets include a permanent magnet and an electromagnet, wherein the permanent magnet is disposed on one of the limiting structure and the limiting portion while the electromagnet is disposed on the other one of the limiting structure and the limiting portion. When electricity is applied to the electromagnet, the electromagnet is magnetically attracted to fix with the permanent magnet.

The invention also provides a multifunctional printer which includes a housing and an inkpot limiting device disposed in the housing. The inkpot limiting device includes a limiting structure, a shaft, a carrier, and a pair of limiting magnets. The limiting structure is disposed on the housing and is located in a diameter direction of the shaft. The carrier has a main body portion and a carrying portion and a limiting portion located at opposite sides of the main body portion, wherein the shaft passes through the main body portion, and therefore the carrier is rotatable around the shaft. The limiting structure and the limiting portion face each other. The limiting magnets include a permanent magnet and an electromagnet, wherein the permanent magnet is disposed on one of the limiting structure and the limiting portion while the electromagnet is disposed on the other one of the limiting structure and the limiting portion. When electricity is applied to the electromagnet, the electromagnet is magnetically attracted to fix with the permanent magnet.

As described above, in the inkpot limiting device of the invention and the multifunctional printer using the inkpot limiting device, whether the electromagnet creates the magnetic force to magnetically attract the permanent magnet is controlled by electricity, thereby limiting the position of the carrier or making the carrier movable relative to the limiting structure.

In order to make the aforementioned features and advantages of the invention more comprehensible, embodiments accompanying figures are described in detail below.

DESCRIPTION OF THE EMBODIMENTS

First Embodiment

Figure 1:
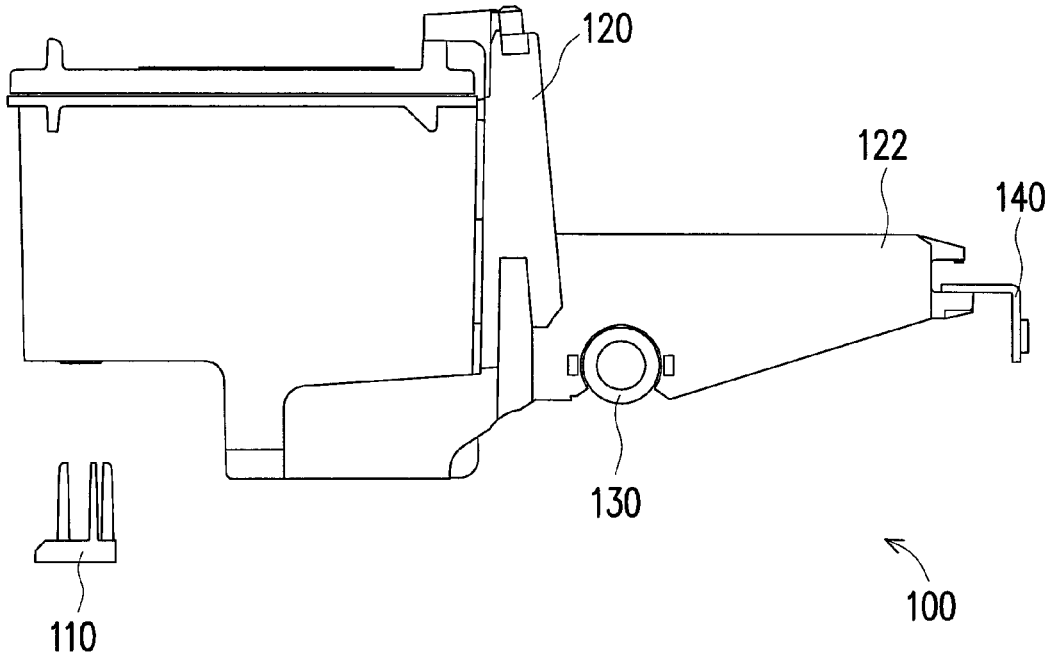
FIG. 1 (RELATED ART)
FIG. 1 and FIG. 2 are partial schematic views of a conventional multifunctional printer.
Figure 2:
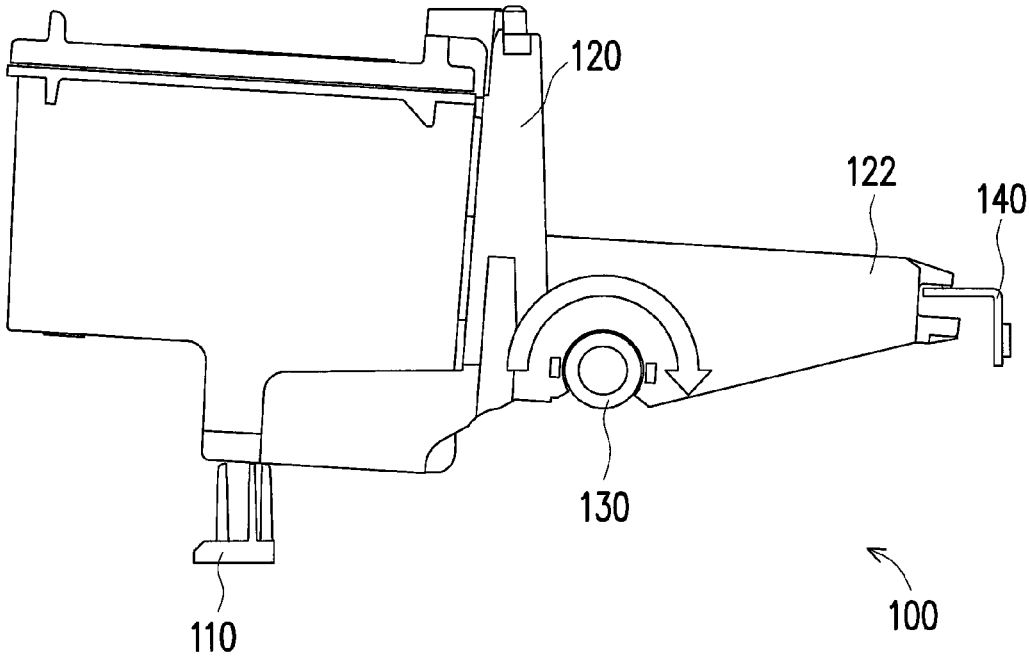
FIG. 2 (RELATED ART)
Figure 3:
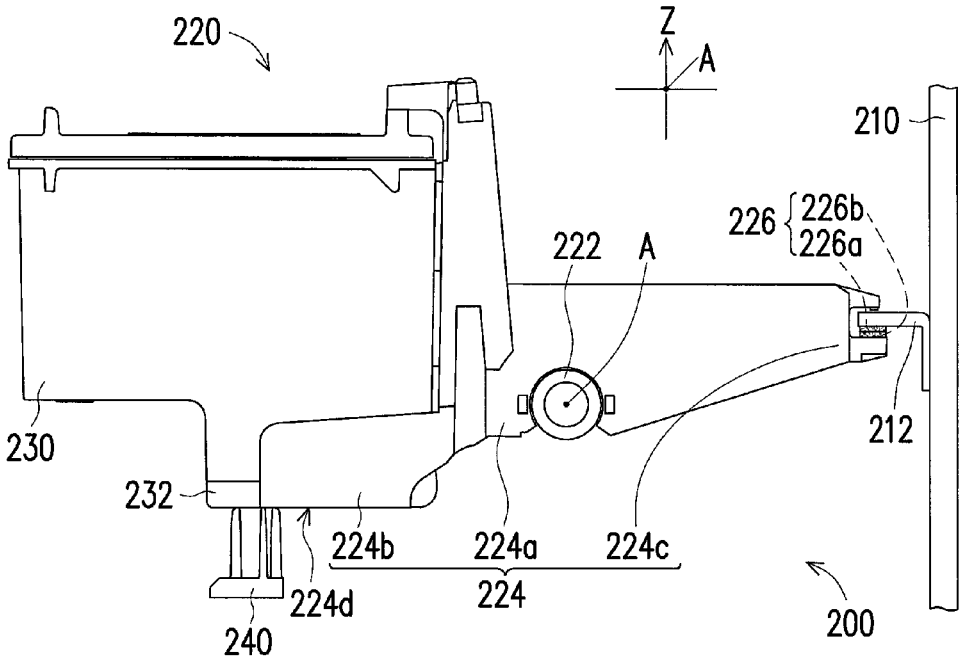
FIG. 3 is a schematic view illustrating a multifunctional printer in accordance with the first embodiment of the invention.

FIG. 3 is a schematic view illustrating a multifunctional printer in accordance with the first embodiment of the invention. Referring to FIG. 3, a multifunctional printer 200 includes a housing 210 and an inkpot limiting device 220 disposed in the housing 210. The inkpot limiting device 220 includes a limiting structure 212, a shaft 222, a carrier 224, and a pair of limiting magnets 226. The limiting structure 212 is disposed on the housing 210, and the limiting structure 212 is disposed in a diameter direction of the shaft 222 and located adjacent to the shaft 222. The carrier 224 has a main body portion **224*a* and a carrying portion 224*b* and a limiting portion 224*c* located at opposite sides of the main body portion 224*a*, wherein the shaft 222 passes through the main body portion 224*a*, and therefore the carrier 224 is rotatable around the shaft 222. The limiting structure 212 and the limiting portion 224*c* face each other. The limiting magnets 226 include a permanent magnet 226*a* and an electromagnet 226*b*, wherein the permanent magnet 226*a* is disposed on the limiting structure 212, and the electromagnet 226*b* is disposed on the limiting portion 224***c*. Persons skilled in the art may switch the locations of the electromagnet 226*b* and the permanent magnet 226*a* based on actual design demands. For example, the permanent magnet 226*a* may be disposed on the limiting portion 224*c*, and the electromagnet 226*b* may be disposed on the limiting structure 212. The same effect may be achieved in both ways.

Figure 4:
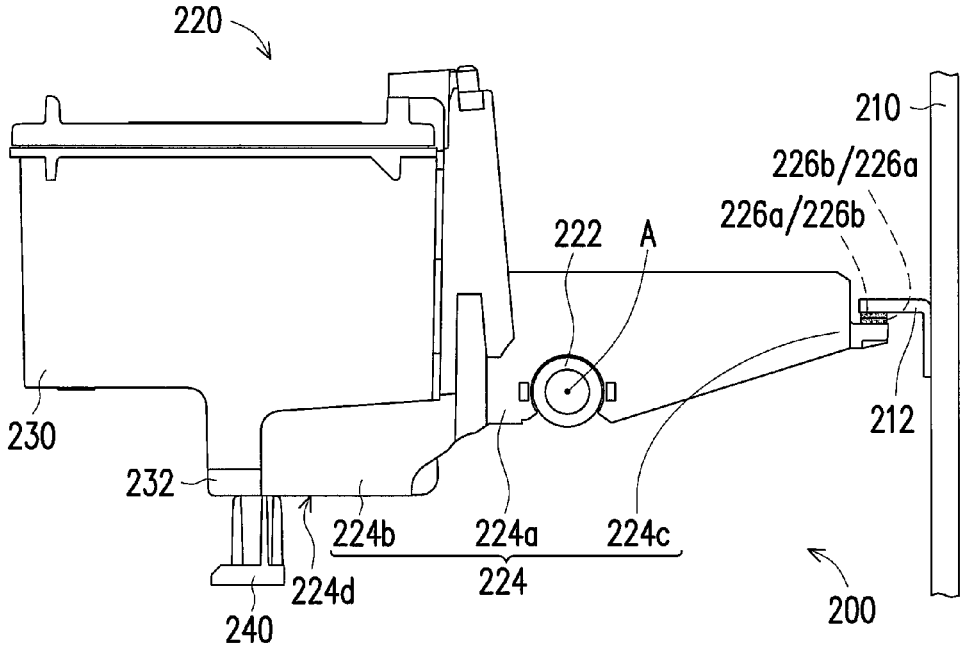
FIG. 4 illustrates a platform-shaped limiting portion of a carrier of FIG. 3.

As described above, the limiting portion 224*c* of the embodiment is a C shape, and the limiting structure 212 extends into an opening of the C-shaped limiting portion 224*c*. However, the C-shaped limiting portion 224*c* is only taken as an example, and the invention is not limited thereto. In another embodiment, the limiting portion 224*c* may be simply a platform shape, and the permanent magnet 226*a* or the electromagnet 226*b* are disposed on the platform-shaped limiting portion 224*c*, wherein the permanent magnet 226*a* and the electromagnet 226*b* face each other as shown in FIG. 4.

Referring to FIG. 3, the multifunctional printer 200 further includes an inkpot 230, and the inkpot 230 is disposed on the carrying portion 224*b* of the carrier 224. In addition, the multifunctional printer 200 further includes a scraper 240, wherein the scraper 240 cleans a tip 232 of the inkpot 230 by scraping surplus ink on a nozzle (not shown) of the tip 232 after the inkpot 230 finishes a printing process on a paper.

More specifically, when the multifunctional printer 200 is conducting the printing process, electricity is not applied to the electromagnet 226*b*. Meanwhile, the electromagnet 226*b* and the permanent magnet 226*a* are not magnetically attracted to each other. Therefore, a position of the carrier 224 is not limited, and the carrier 224 is able to move reciprocally along an axis direction A of the shaft 222 to perform the printing process.

Then, when the printing process of the multifunctional printer 200 is done with the paper, electricity is applied to the electromagnet 226*b*, wherein a magnetic force is formed by the electromagnet 226*b* after electricity is applied and the electromagnet 226*b* is magnetically attracted to fix with the permanent magnet 226*a*, so as to fix the carrier 224. Accordingly, a distance between a bottom surface 224*d* of the carrier 224 and the scraper 240 on a perpendicular direction Z is maintained at a fixed value, wherein the perpendicular direction Z is perpendicular to the axis direction A. Persons skilled in the art also may know, when the inkpot 230 is disposed on the carrier 224, the scraper 240 also maintains a fixed distance relative to a bottom surface of the tip 232 of the inkpot 230 on the perpendicular direction, wherein the distance usually enables the scraper 240 to contact the bottom surface of the tip 232 of the inkpot 230 when the scraper 240 moves relative to the inkpot 230. Therefore, when the scraper 240 is moving along an ink cleaning direction and contacts the tip 232 of the inkpot 230, the magnetic force between the electromagnet 226*b* and the permanent magnet 226*a* is greater than the force which the scraper 240 uses to lift the carrying portion 224*b* of the carrier. Thus, the position of the carrier is limited by the magnetic attraction between the electromagnet 226*b* and the permanent magnet 226*a*. When the scraper 240 contacts and moves relative to the tip 232, the carrier may not rotate around the axis direction A as a center nor be lifted. Thus, the scraper 240 is enabled to effectively clean the surplus ink on the tip 232.

Second Embodiment

The second embodiment is similar to the above mentioned first embodiment, and the same or similar reference numbers used in this embodiment and the aforementioned embodiment represent the same or similar elements. Therefore, only the differences are described below.

Figure 5:
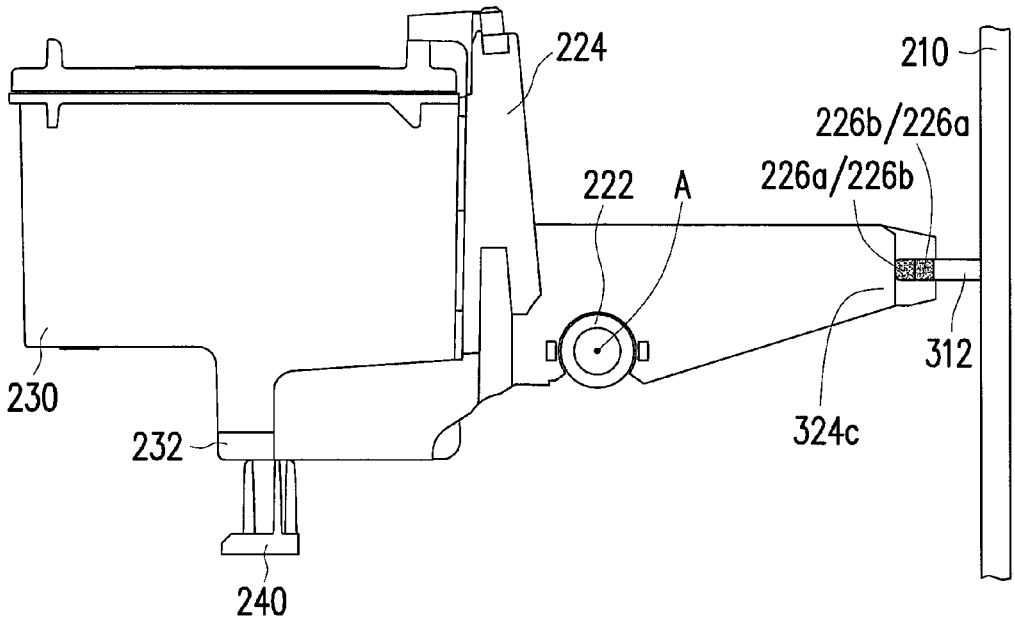
FIG. 5 is a schematic view of a multifunctional printer in accordance with the second embodiment of the invention.

FIG. 5 is a schematic view of a multifunctional printer in accordance with the second embodiment of the invention. Referring to FIG. 5, in this embodiment, a limiting structure 312 is an introducer, and a limiting portion 324*c* is a guide rail. The permanent magnet 226*a* and the electromagnet 226*b* are disposed on a surface of the limiting structure 312 and a surface of the limiting portion 324*c* respectively, wherein the surfaces of the limiting structure 312 and the limiting portion 324*c* face each other. Certainly, persons skilled in the art may modify the design to use the guide rail as the limiting structure 312 and use the introducer as the limiting portion 324*c*.

More specifically, the introducer extends into the guide rail to first confine a height of the tip 232 of the inkpot 230 relative to the scraper 240. Similarly, when electricity is not applied to the electromagnet 226*b*, a carrier is able to move reciprocally along the axis direction A of the shaft 222 to perform a printing process. Then, when the printing process is done with a paper, electricity is applied to the electromagnet 226*b*, so that the electromagnet 226*b* creates a magnetic force and magnetically attracts to fix with the permanent magnet, thereby limiting the position of the carrier and the height of the carrier relative to the scraper 240.

In brief, the electromagnet 226*b* and the permanent magnet 226*a* are disposed respectively on the limiting portion 224*c* and the limiting structure in the inkpot limiting device of the invention and the multifunctional printer using the inkpot limiting device. Then, whether electricity is applied decides whether the position of the carrier and the height relative to the scraper 240 are limited. Thus, as long as electricity is not applied to the electromagnet 226*b*, the magnetic force is not existed; then, the carrier is able to move reciprocally on the shaft, and the printing process is not affected. Then, when the printing process is done, electricity is applied to the electromagnet 226*b* in order for the electromagnet 226*b* to create the magnetic force. Thus, the electromagnet 226*b* is magnetically attracted to fix with the permanent magnet 226*a*, and the position and the height of the carrier relative to the scraper are then fixed. Therefore, when the tip 232 of the inkpot contacts the scraper, the carrying portion of the carrier is not lifted by the scraper. Thus, the scraper is able to effectively clean the surplus ink on the tip 232.

Although the invention has been disclosed by the above embodiments, they are not intended to limit the invention. It will be apparent to those of ordinary skill in the art that modifications and variations to the invention may be made without departing from the spirit and the scope of the invention. Accordingly, the protection scope of the invention falls in the appended claims.

What is claimed is:

1. An inkpot limiting device for limiting a position of an inkpot, the inkpot limiting device comprising:

a limiting structure;

a shaft, wherein the limiting structure is located in a diameter direction of the shaft;

a carrier comprising a main body portion, a carrying portion, and a limiting portion, wherein the carrying portion and the limiting portion are located at opposite sides of the main body portion, the shaft passes through the main body portion in a way that the carrier is rotatable around the shaft, and the limiting structure and the limiting portion face each other; and a pair of limiting magnets comprising:

a permanent magnet disposed on one of the limiting structure and the limiting portion; and an electromagnet disposed on the other one of the limiting structure and the limiting portion, wherein when an electricity is applied, the electromagnet is magnetically attracted to fix with the permanent magnet.

2. The inkpot limiting device according to claim 1, wherein the limiting portion is a C shape and the limiting structure is extended and located in an opening of the C-shaped limiting portion.

3. The inkpot limiting device according to claim 1, wherein the limiting structure is disposed in a housing of a multifunctional printer.

4. The inkpot limiting device according to claim 1, wherein the limiting structure is one of a guide rail or an introducer while the limiting portion is the other one of the guide rail or the introducer.

5. The inkpot limiting device according to claim 1, wherein when the electricity is not applied, the electromagnet and the permanent magnet are not attracted to each other by a magnetic force, and the carrier is adapted to move along an axis direction of the shaft.

6. A multifunctional printer comprising:

a housing;

an inkpot limiting device disposed in the housing and comprising:

a limiting structure disposed on the housing;

a shaft, wherein the limiting structure is located in a diameter direction of the shaft;

a carrier comprising a main body portion, a carrying portion, and a limiting portion, wherein the carrying portion and the limiting portion are located at opposite sides of the main body portion, the shaft passes through the main body portion in a way that the carrier is rotatable around the shaft, and the limiting structure and the limiting portion face each other; and a pair of limiting magnets comprising:

a permanent magnet disposed on one of the limiting structure and the limiting portion; and an electromagnet disposed on the other one of the limiting structure and the limiting portion, wherein when an electricity is applied, the electromagnet is magnetically attracted to fix with the permanent magnet.

7. The multifunctional printer according to claim 6, wherein the limiting portion is a C shape and the limiting structure is extended and located in an opening of the C-shaped limiting portion.

8. The multifunctional printer according to claim 6, wherein the limiting structure is one of a guide rail or an introducer, and the limiting portion is the other one of the guide rail or the introducer.

9. The multifunctional printer according to claim 6, wherein when the electricity is not applied, the electromagnet and the permanent magnet are not attracted to each other by a magnetic force, and the carrier is adapted to move along an axis direction of the shaft.

10. The multifunctional printer according to claim 6, further comprising a scraper, wherein when the electricity is applied and the electromagnet is magnetically attracted to fix with the permanent magnet, a distance between a bottom surface of the carrier and a scraper in a perpendicular direction is maintained at a fixed value, and the perpendicular direction is perpendicular to the axis direction of the shaft.

11. The multifunctional printer according to claim 6, further comprising an inkpot disposed on the carrying portion of the carrier.

12. The multifunctional printer according to claim 11, further comprising a scraper, wherein when the electricity is applied and the electromagnet is magnetically attracted to fix with the permanent magnet, a distance between a bottom surface of a tip of the inkpot and the scraper in a perpendicular direction is maintained at a fixed value, and the perpendicular direction is perpendicular to the axis direction of the shaft.

* * * * *